US005586584A

United States Patent [19]

Haldemann

[11] Patent Number: 5,586,584

[45] **Date of Patent: * Dec. 24, 1996**

[54] FENCING TOOL AND METHOD OF OPERATION

[76] Inventor: Pol N. Haldemann, P.O. Box 879, Chinook, Mont. 59523

[ * ] Notice: The term of this patent shall not extend beyond the expiration date of Pat. No. 5,303,748.

[21] Appl. No.: 212,341

[22] Filed: Mar. 11, 1994

Related U.S. Application Data

[63] Continuation-in-part of Ser. No. 122, Jan. 2, 1987, Pat. No. 5,303,748.

[51] Int. Cl.[6] ..... B21F 9/02

[52] U.S. Cl. ..... 140/123.5

[58] Field of Search ..... 140/117, 118, 140/121, 123, 123.5, 123.6

[56] References Cited

U.S. PATENT DOCUMENTS

| | | | |
|---|---|---|---|
| 885,816 | 4/1908 | Weyeneth . | |
| 1,293,966 | 2/1919 | Springer | 7/137 |
| 1,362,797 | 12/1920 | Hose . | |
| 1,382,109 | 6/1921 | Matsler . | |
| 1,495,028 | 5/1924 | Mitchell . | |
| 1,532,147 | 4/1925 | MacPherson . | |
| 1,644,352 | 10/1927 | Perrin . | |
| 1,675,476 | 4/1928 | West . | |
| 1,949,335 | 2/1934 | Settles . | |
| 2,313,530 | 3/1943 | Feigion . | |
| 2,462,250 | 2/1949 | Andrews . | |
| 2,681,203 | 6/1954 | Seger . | |
| 2,929,415 | 3/1960 | Miesner | 140/121 |
| 2,967,303 | 1/1961 | Wise . | |
| 4,208,749 | 6/1980 | Hermann et al. | 7/133 |
| 5,303,748 | 4/1994 | Haldemann | 140/123 |

*Primary Examiner*—Lowell A. Larson

[57] ABSTRACT

A two-handled pliers-type fencing tool having a circular jaw pin which provides a fulcrum point allowing the user to stretch wire is disclosed. The fencing tool further provides an upper arcuate surface terminating in double tines for removing staples and a wire-gripping pincer, a hammer pad, and cutting notches near the pivotal point of the scissors-type tool. Methods for repairing of fence and stretching of wire are also disclosed.

3 Claims, 7 Drawing Sheets

Fig. 13
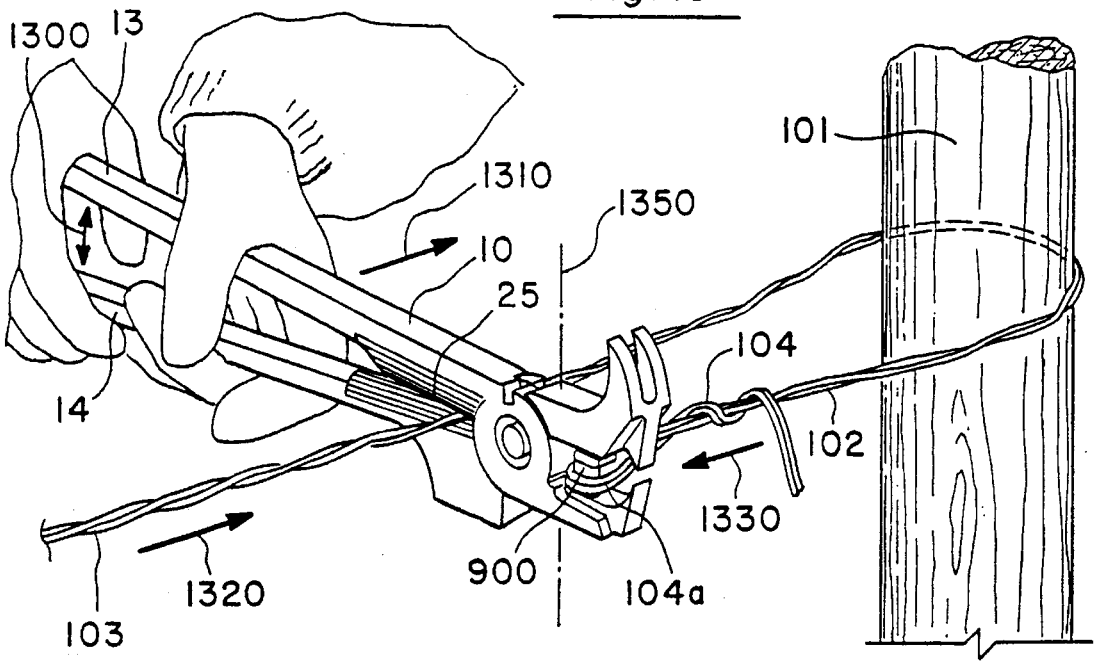
Fig. 14
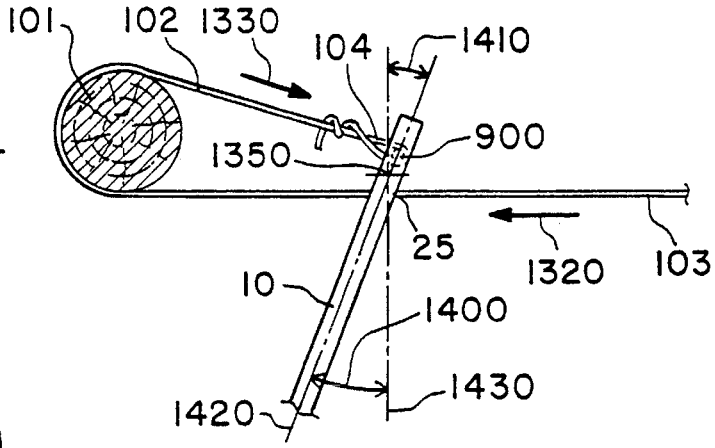
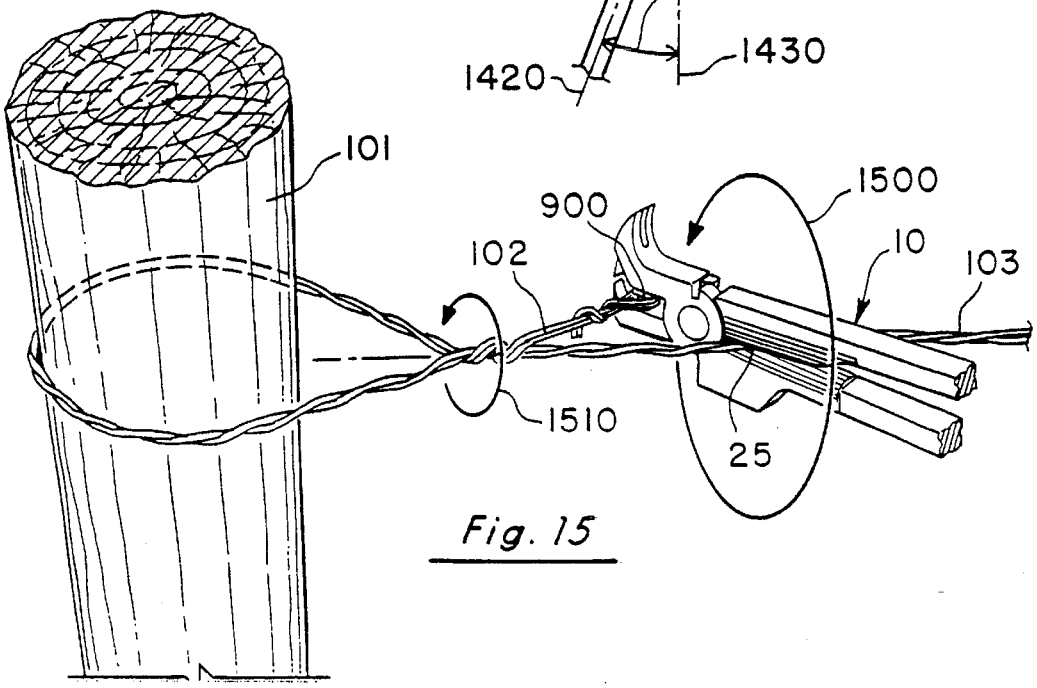
Fig. 15

Fig. 16 (a)
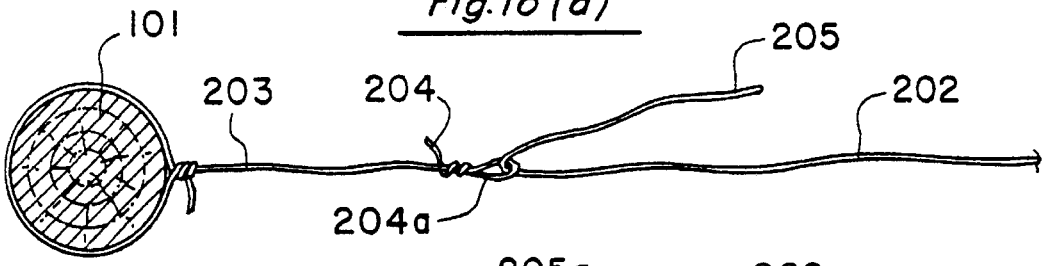
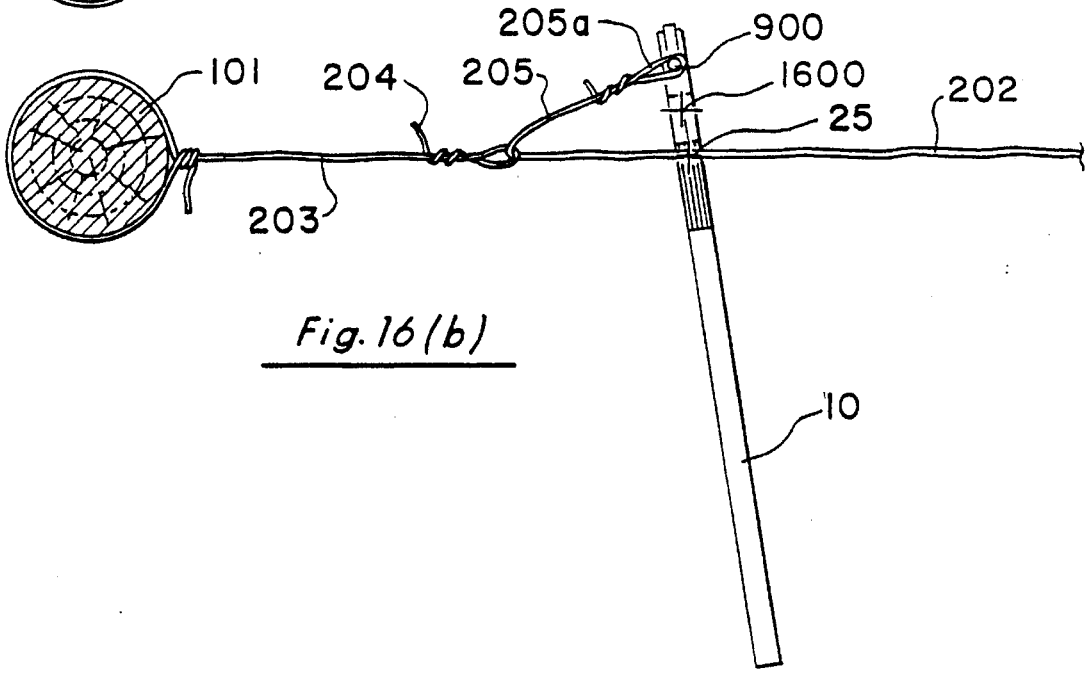
Fig. 16 (b)
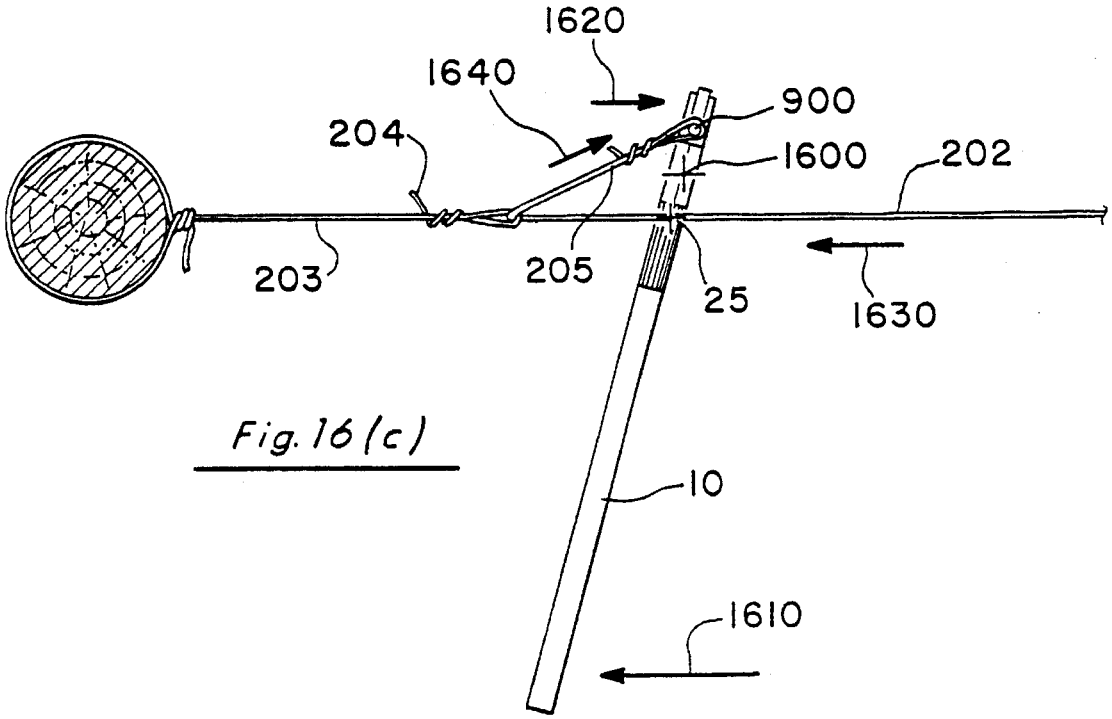
Fig. 16 (c)

Fig. 17(a)
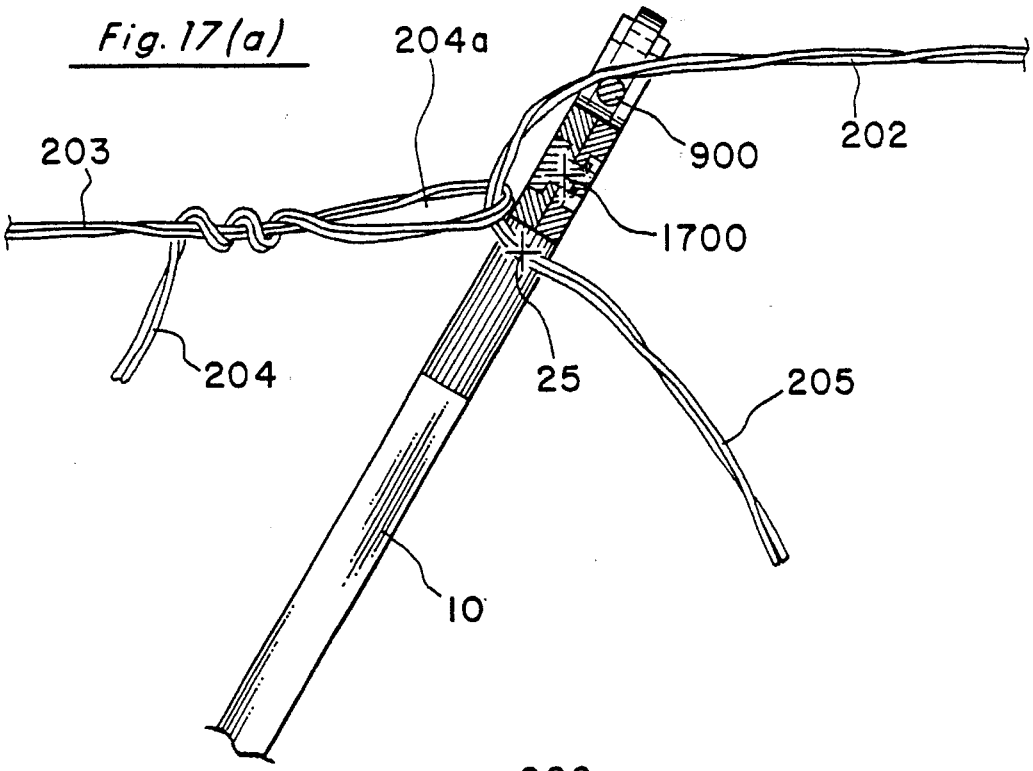
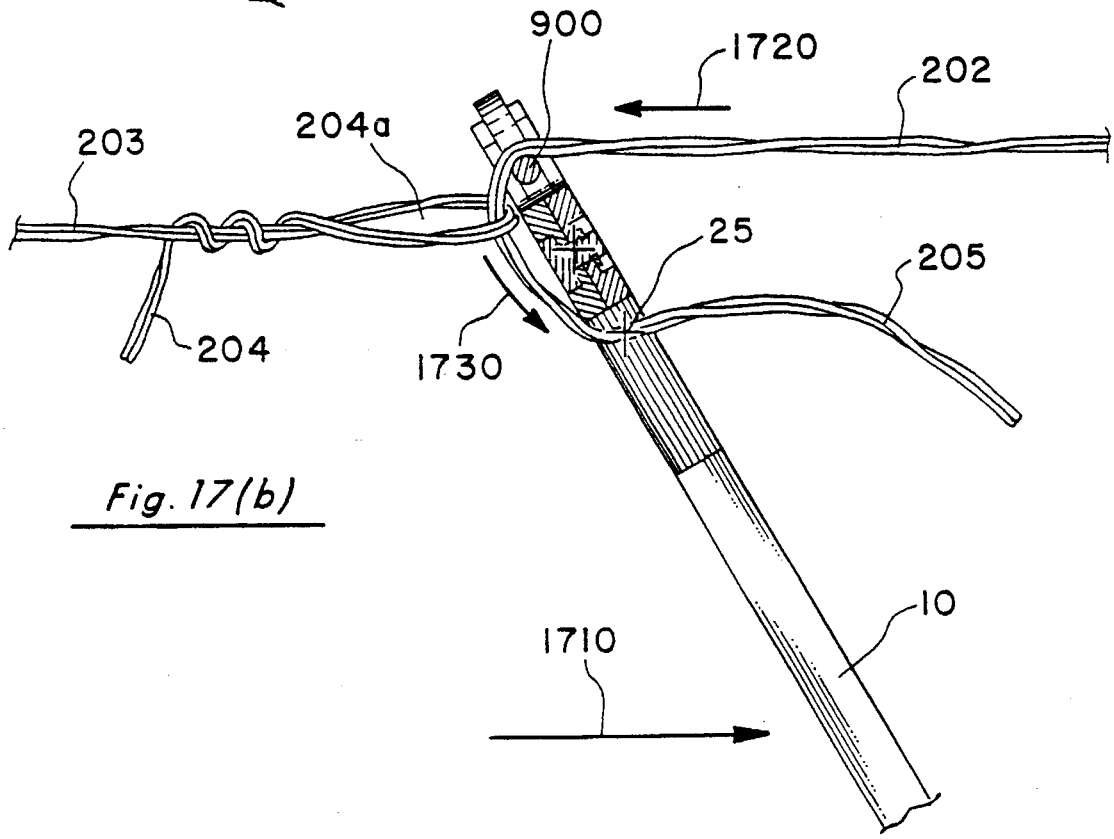
Fig. 17(b)

FENCING TOOL AND METHOD OF OPERATION

RELATED INVENTION

This invention is a continuation-in-part of "Fencing Tool" filed Jan. 2, 1987, Ser. No. 07/000,122, now U.S. Pat. No. 5,303,748.

BACKGROUND OF THE INVENTION

1. Field of the Invention

The invention relates to a fencing tool and in particular to a fencing tool which can be used for stretching wire.

2. Statement of the Problem

Maintaining fence and, in particular, barbed wire is a never ending job. Livestock, wildlife and the elements are continually working to loosen and break fence. Many farmers and ranchers find that it is necessary to continually inspect and repair their existing fences, whether by motorized vehicle, by walking, or on horseback. In order to adequately repair fence, it is often necessary to add an additional length of wire and then stretch the wire to insure that it is taut. The conventional manner of stretching fence wire is to use a fence stretcher. Conventional fence stretchers use mechanical advantage by employing ratchets, pulleys, and/or ropes or the like. Conventional fence stretchers are heavy and cumbersome to carry, set up, and use.

While one is engaged in repairing fence, it is necessary to have a pair of pliers or other tool which will allow one to remove staples, remove clips from metal posts, crimp wire, cut wire, and pound staples and nails. In the past, it has been a custom to use conventional fencing pliers which allow one to crimp wire and pound staples but do not allow a person to adequately pull staples or stretch wire when needed.

The ideal fencing tool would provide the necessary gripping, pounding, and pulling functions as well as incorporating the means for stretching wire to facilitate total fence repair. Such a combination tool should be convenient to carry so that additional tools are not needed when walking along a fence or while riding horseback.

A need exists for a combination tool which will stretch wire, pound staples, crimp wire, place or remove clips on steel posts, and still be light enough to be placed into a holster or buckled onto a belt. A need exists for a single tool that will perform those functions so that one can repair a fence without the necessity of carrying a fence stretcher and assorted other tools.

Other prior art fencing tools and pliers having various arrangements in combinations are known. Examples of such tools include U.S. Pat. No. 1,382,109 to Matsler issued Jun. 21, 1921, U.S. Pat. No. 1,532,147 to MacPherson issued Apr. 7, 1925, U.S. Pat. No. 2,462,250 to Andrews issued Feb. 22, 1949, U.S. Pat. No. 885,816 to Weyeneth issued Apr. 28, 1908, U.S. Pat. No. 1,495,028 to Mitchell issued May 20, 1924, U.S. Pat. No. 1,644,352 to Perrin issued Oct. 4, 1927, U.S. Pat. No. 1,675,476 to West issued Jul. 3, 1928, U.S. Pat. No. 1,949,335 to Settles issued Feb. 27, 1934, U.S. Pat. No. 2,313,530 to Feigion issued Mar. 9, 1943, U.S. Pat. No. 2,681,203 to Seger issued Jun. 15, 1954, and U.S. Pat. No. 2,967,303 issued Jan. 10, 1961.

These tools and pliers do not solve the problems relating to a combination fencing tool pliers for pulling staples, driving staples, crimping wire, and directed to a combination fencing tool which will also grip the wire and stretch it across a fulcrum bar.

Accordingly, a need exists fora fencing plier that would provide a safe, convenient balanced tool that allows one to repair fence without the use of any other tool. The tool should not only crimp wire, drive and pull staples, but also stretch the wire without the use of additional tools. A fencing tool of that type would provide a fulcrum stretching mechanical advantage and yet the tool would be simple in design, easy to maintain, and would accommodate different types of wire, staples, and varying fencing conditions.

The device should be uncomplicated in design, easily carried by slipping it through a belt or wearing on a holster. It should be lightweight, not subject to damage by proper use, and simple to manufacture. The instant invention is directed to all of these needs as well as to others as explained in the following summary.

SUMMARY OF THE INVENTION

It is a feature of the invention to provide a fencing tool.

It is another feature of the instant invention to provide a fencing tool having balance and mechanical advantage by having sufficiently long handles.

It is another feature of the instant invention to provide a fencing tool having a hammer pad, shears for cutting wire, plier-jaw pincers, dual-pronged staple puller, wire-holding gripping surface, and a fulcrum bar for stretching wire.

These and other features and objects are attained according to the instant invention by providing a fencing tool having two parts pivotally joined in a scissor-like fashion with elongate handles. A hammer pad is provided on the handle side of the pivot and a wire-gripping pincer is provided at the head of the tool along with an arcuate upper surface having a pair of tines useful for extracting staples by straddling a wire. A fulcrum bar is attached to one side of the working head and, in a first embodiment, is telescopically inserted in an aperture in the opposite working head and, in a second embodiment, is not telescopically inserted. The fulcrum bar is spaced from the pivot point and the pincer point so that wire may be inserted over the fulcrum bar for stretching. On the handle side of the tool, a wire-gripping surface is provided so that the wire may be gripped and stretched over the fulcrum bar using the mechanical advantage of the long handles. Shearing notches are provided on either side of the pivot.

BRIEF DESCRIPTION OF THE DRAWING

FIG. 13 is a perspective view illustrating the use of the Second Embodiment of the Fencing Tool to stretch a wire around a wooden post;

FIG. 14 is a top view corresponding to FIG. 13 illustrating the ratcheting effect of the Second Embodiment of the present invention to tighten the wire;

FIG. 15 is a perspective view of the Second Embodiment of the Fencing Tool being used to connect the loose end of wire to tightened wire;

FIG. 16 illustrates the steps using the Second Embodiment of the Fencing Tool in stretching one wire against another wire;

FIG. 17 illustrates a second and alternate method of stretching one wire to another wire using the Second Embodiment of the Fencing Tool.

DESCRIPTION OF THE PREFERRED EMBODIMENT

1. First Embodiment

The first embodiment of the fencing tool apparatus of the instant invention is depicted generally in FIGS. 1–8 as numeral 10.

A. Construction of First Embodiment

Figure 1:
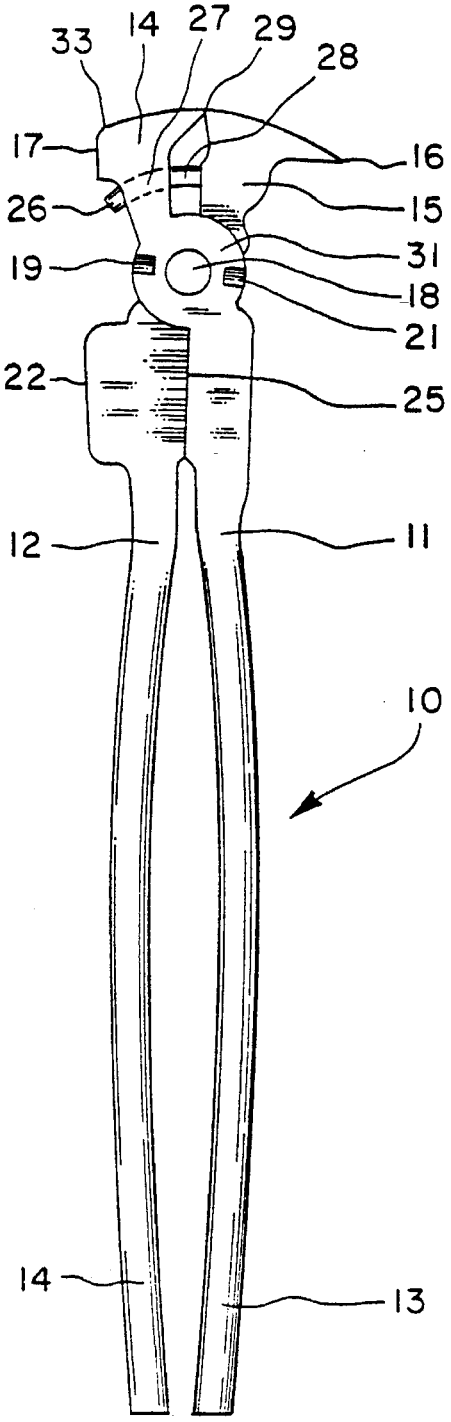
FIG. 1 is a front elevational view of the Fencing Tool in a closed configuration in accordance with the present invention.
Figure 2:
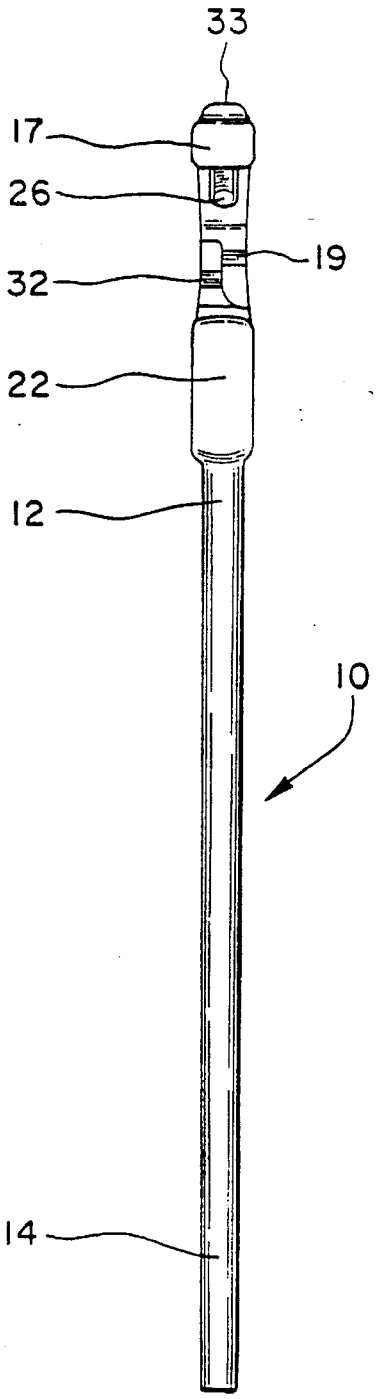
FIG. 2 is a side elevational view of the Fencing Tool looking at the hammer pad area.

As can be seen by reference to FIG. 1, the fencing tool 10 has two solid parts forming a scissors-like arrangement about a pivot 18. The first portion 11 includes an elongate handle 13 which is depicted as being tubular; however, in the manufacture of the tool, it is contemplated that any convenient handle shape would be appropriate without departing from the specification. First body portion 11 includes handle portion 13 as previously mentioned and upper working portion 14 which is that part of first body portion 11 that extends above pivot 18 opposite the handle portion 13. Upper working portion 14 includes hammer portion 17 and arcuate upper surface 33. It can also be seen from reference to FIGS. 1, 2, and 4 that a pair of notches 21 and 19 are provided to co-act with notches 51 and 52 of second body portion 12 to provide a wire shear for the cutting of wire. Upper working portion 14 of first body portion 11 is further tapered to a point 54 as shown in FIG. 4 to provide a gripping pincer 29 as shown in FIG. 1.

The second portion 12 includes an elongate handle 14 which is depicted as being tubular. However, in the manufacture of the tool it is also contemplated that any convenient handle shape would be appropriate without departing from the specification. Second body portion 12 is provided with large hammer pad 22 on the handle portion 14 and second upper working portion 15 past pivot 18 is provided with a fulcrum bar 28 which is curved so that the end 26 of fulcrum bar 28 fits into an aperture 27 in first body portion 11. The upper working portion 15 of second body portion 12 is also provided with an upper arcuate surface 41 and tines 16 and 46 as shown in FIGS. 1, 3, and 4.

Figure 3:
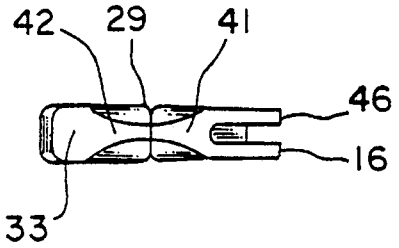
FIG. 3 is a top plan view of the Fencing Tool showing the head area in accordance with the present invention.

With careful reference to FIG. 3, it can be seen that pincer portions 41 and 42 of fencing tool 10 are narrowed to a point to provide a narrow pincer point 29 for the convenient gripping of staples and wire. With reference to FIGS. 1 and 4 where the tool is shown in both a closed and open position, it can be seen that wire gripping surfaces 25 provide a plier or gripping surface on the handle side 13 and 14 of pivot point 18. Gripping surface 25 is important in that for the use of the fencing tool for stretching a wire is gripped upon gripping surfaces 25 and stretched across fulcrum bar 28 by use of the leverage provided with elongate handles 13 and 14.

Figure 4:
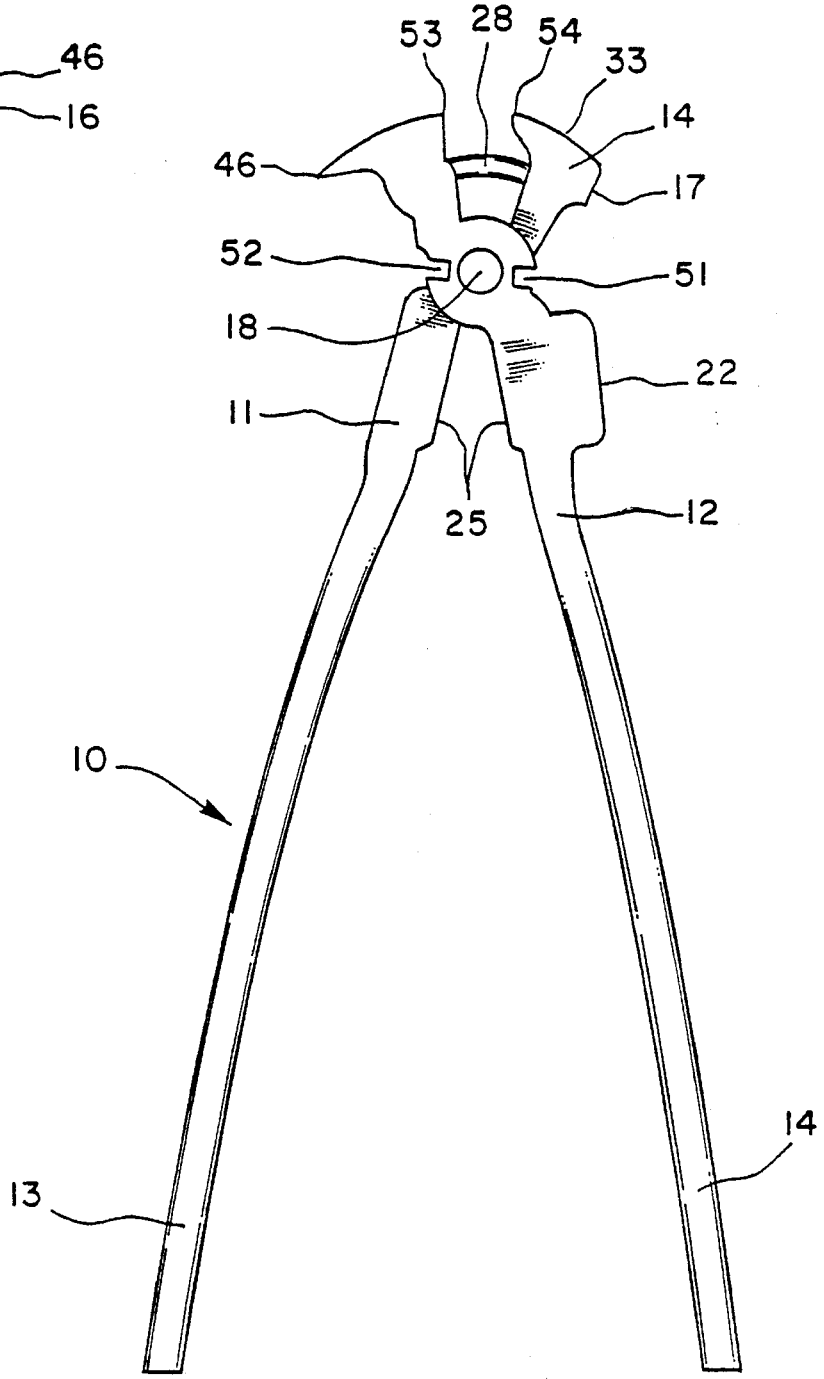
FIG. 4 is a rear elevational view of the Fencing Tool in an open position in accordance with the present invention.

Fulcrum bar 28 which is an integral portion of second body portion 12 could be of any shape; however, it has been found that having a rounded or cylindrical yet a curved shape as depicted in FIGS. 1 and 4 provides the best surface for wire to be stretched using fulcrum bar 28.

With reference to FIGS. 1, 3 and 4, it can be seen that tines 16 and 46 are spaced so that tines 16 and 46 can fit on either side of a staple in much the same manner as one would use a conventional claw hammer to allow one to pull a staple or nail.

B. Method of Tightening Fence Wire to a Post

Figure 5:
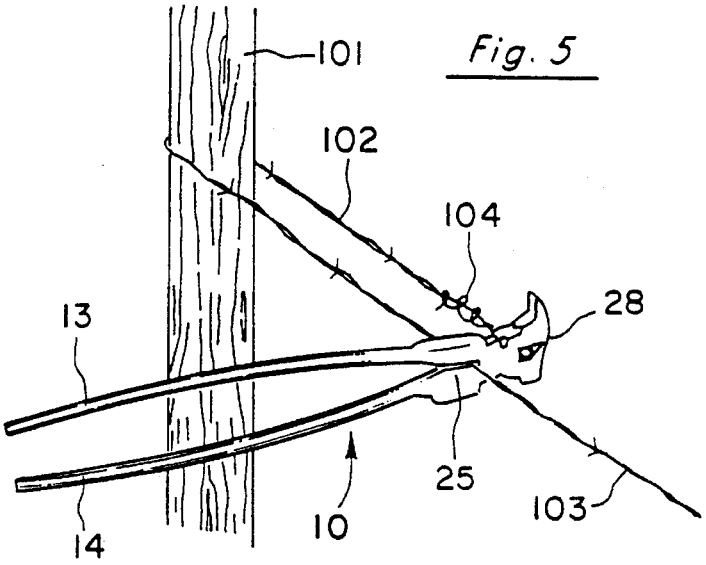
FIG. 5 is a perspective view of the Fencing Tool in use stretching wire around a wooden post.

The operation and use of fencing tool 10 will now be described. With reference to FIG. 5, it can be seen that barbed wire 103 is placed about wooden pole 101 so that extended portion 102 extends beyond and parallel to wire portion 103. It is contemplated that the stretching operation as shown in FIG. 5 has been accomplished by having first attached a length of wire to a broken wire so that barbed wire 103 is sufficiently long. The method of splicing or attaching the wire could be any conventional method such as twisting the strands together or by producing two loops in the wire that co-act to provide a splice. Once the wire has been extended as depicted in FIG. 5, then an excess portion of the wire is bent back along extended portion 102 and twisted into a twist portion 104. The fencing tool 10 is then opened beyond the opening as depicted in FIG. 4 so much so that the bitter end of fulcrum bar 26 as depicted n FIG. 1 is open to receive the loop of wire created by the twisting of wire 104. Once the fulcrum bar is inserted within the loop created by the twisted portion of the wire 104, then the elongate handles 13 and 14 of fencing tool 10 ar closed to allow wire gripping surfaces 25 to grip wire 103. By gripping the wire in this manner and then urging a force against elongate handles 13 and 14 toward post 101, wire 103 is stretched to a point where grips 25 can be released while still maintaining tension on loop 104 with fulcrum bar 28. Wire 102 can then be held tightly against post 101 and a wrap of wire can be made around post 101. Loop 104 can then be removed from fulcrum bar 28 and wire 102 can be wrapped around wire 103 to secure the wire tension. This procedure could also be used with the fencing tool 10 in the construction of new fence and could be used not only with conventional wire but also any other material used in place of wire whether metal, plastic, or of other material.

C. Method of Splicing Two Wires Together

Figure 6:
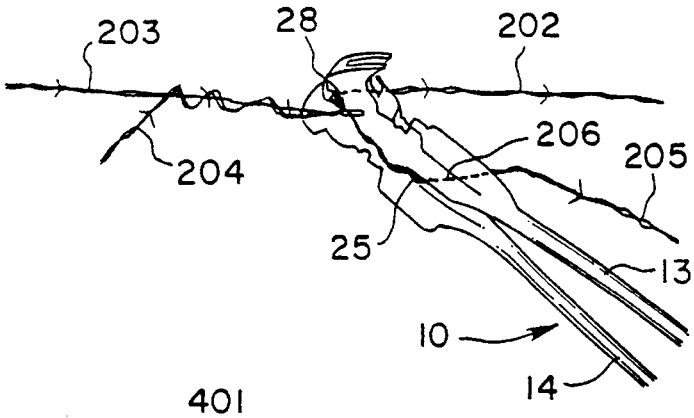
FIG. 6 is a perspective view of the Fencing Tool in stretching position stretching a wire against another wire.

With reference to FIG. 6, another way of stretching wire or other material that may take the place of wire can be accomplished by use of fencing tool 10. It is contemplated that an additional length of wire 202, whether barbed or barbless, has been added so that there is sufficient wire to work with. A loop is created by twisting bitter end 204 about first wire 203 to create a loop in which first end of second wire 205 is inserted through the loop to make a loose joint. wire 202 is then routed about fulcrum bar 28 of fencing tool 10 and wire 205 is routed through the loop created in wire 203 and then placed in gripping relationship with gripping surfaces 25 as handles 13 and 14 are urged toward one another. when the wire 202 is so gripped, then force applied on handles 13 and 14 toward wire 202 creates a mechanical advantage of pulling wire portion 206 of wire 205 and thereby stretching wire 202 to a point at which the end of wire 205 could be wrapped around wire 202 to complete the splice. At the time that wire 205 is wound around wire 202, both wires 203 and 202 would be taut.

D. Method of Removing Staples

Figure 7:
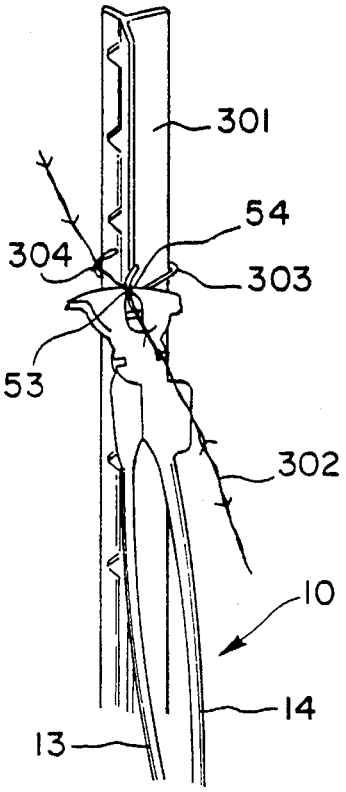
FIG. 7 is a perspective view of the Fencing Tool and a metal post, depicting the Fencing Tool removing or installing a clip in accordance with the present invention.

With reference to FIG. 7, it can be shown that fencing tool 10 can be used to remove wire staples used for holding barbed wire 302 onto metal post 301. Clip 303 would have to be removed from wire 302 in order to stretch the wire. Otherwise it could bind against clip end 304. It has been found by using fencing tool 10 as shown in FIG. 7 that the clip 303 can be removed without damage and reused, thus saving the expense and weight of carrying additional clips while repairing fence. The method of removing the staple 303 is to grip staple 303 with the pincer point 29 which is the point at which ends 54 and 53 of fencing tool 10 co-act. By taking the pincer point and gripping the end of staple 303, particularly where wire 302 is placed within the space between fulcrum bar 28 and pincer point 29, a simple twisting in a counterclockwise direction of elongate handles 13 and 14 as depicted in FIG. 7 would open wire clip 303 to allow it to be taken off of metal post 301. To place a clip onto wire 302 and metal post 301, one simply reverses the process to crimp clip 303.

Figure 8:
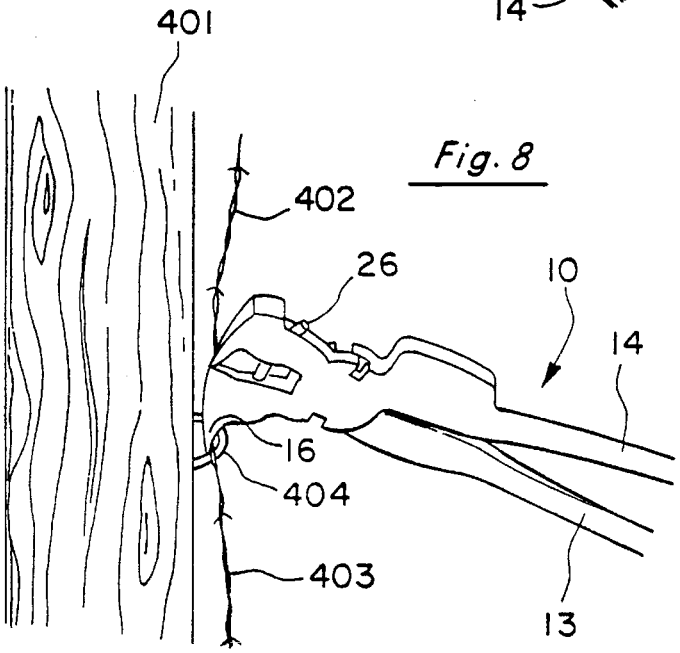
FIG. 8 is a partial perspective view of the present invention depicting the Fencing Tool in the final pulling stage of removing a staple from a wooden post in accordance with the present invention.

With reference to FIG. 8, description of the pulling of a staple using fencing tool 10 will be accomplished. As previously noted, the upper portion 15 of second body portion 12 is provided with spaced tines 16 and 46 as shown in FIG. 3. If a wire 402 having a U-shaped staple 404 is to be pulled, one simply places tines 16 and 46 in a straddling relationship to staple 404 and by rotating handles 13 and 14 in an upward manner as depicted in FIG. 8, the tines 16 and 46 push against wire 402, thus imparting a force to the curved portion of staple 404 to remove it from post 401 without damage to either staple 404 or wire 402. By so removing staples in a condition so that they can be reused, fencing tool 10 reduces the need to carry additional new staples and thus facilitates the repairing of fences.

One of the advantages of fencing tool 10 is in the elongate handles 13 and 14 having a length at least five times the length of the distance from the pivot point to pincer point 29. By having such an advantage of five times, it has been found that the stretching operation as previously described can be accomplished much more readily than if handles 13 and 14 were of a shorter length.

When it is necessary to pound a staple or nail or whatever, one can simply use the hammer pad 22 which is part of second body portion 12 to pound against a staple by griping together handles 13 and 14 and aiming hammer pad 22 at the desired point of impact. It will be noted that the angle of the surface on hammer pad 22 is such that a pivoting motion of an arm and a hammer fashion when gripping handles 13 and 14 would provide a straight downward impact upon a staple or nailhead.

In order to cut wire by the use of fencing tool 10, one simply places the wire in the spaces either 51 or 52 as shown in FIG. 4 and then by closing the handles 13 and 14 toward each other, the shearing action is accomplished thus severing any wire that is placed there. by having handles 13 and 14 at the length as previously described, it is much easier to sever wire than if the handles 13 and 14 were shorter.

2. Second Embodiment

In FIGS. 9–17, is shown a second embodiment of the fencing tool the present invention. Where possible, like numerals refer to like structure in the first embodiment of FIGS. 1–8. Discussion concerning these like components is found with respect to the first embodiment and is not repeated here.

A. Construction of the Second Embodiment

In FIGS. 9–17, a different shaped fulcrum bar 900 is shown. Unlike the first embodiment for fulcrum bar 28, the second embodiment for the fulcrum bar 900 is straight or linear as clearly shown in FIG. 12. The linear bar 900 terminates in a cap 910 which is flush on side 920 with bar 900 and which provides an overhang 930 on the remaining sides. The linear bar 900 is circular or rounded and it is to be expressly understood the cross-section of bar 900 could be oval in shape, circular, or any other suitable curved surface.

Figure 9:
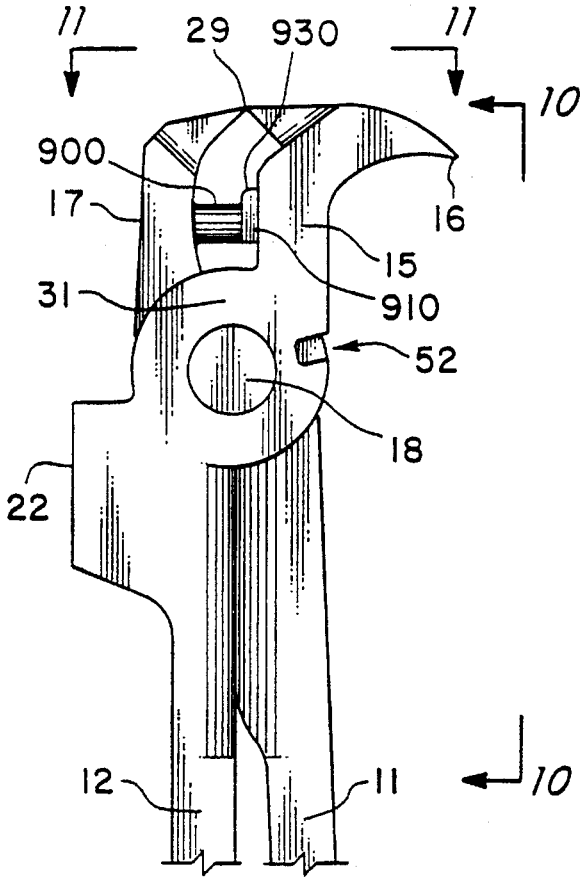
FIG. 9 is a partial front elevation view of the Second Embodiment of the Fencing Tool in a closed configuration in accordance with the present invention.
Figure 10:
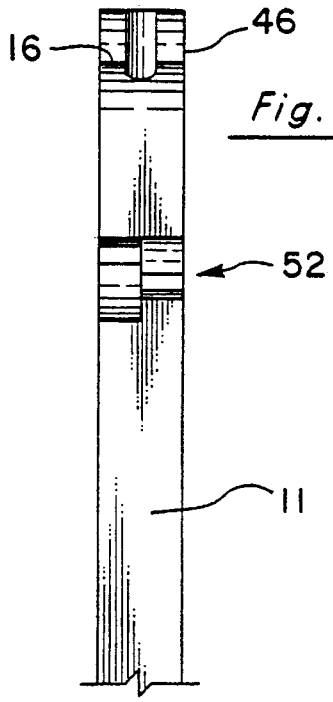
FIG. 10 is a partial side elevation view of the Second Embodiment of the Fencing Tool looking at hammer pad area.
Figure 11:
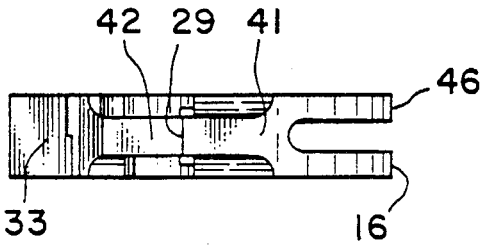
FIG. 11 is a top plan view of the Second Embodiment of the Fencing Tool showing the head area.
Figure 12:
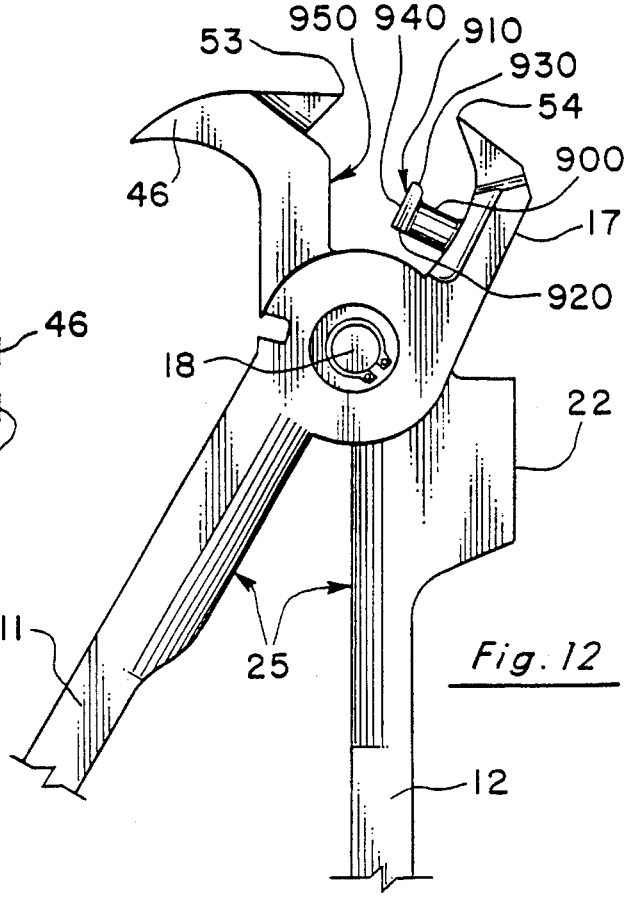
FIG. 12 is a partial rear elevational view of the Second Embodiment of the Fencing Tool in an open position.

Unlike the first embodiment, an aperture 27 is not required. Indeed, second upper working portion 15 does not have a formed hole or aperture therein. The cap 910 has a flat surface 940 which substantially abuts against a corresponding flat surface 950 of the second upper working portion 15. The length of the fulcrum bar 900 is such that when pincer point 29 which is the point at which ends 54 and 53 co-act together and touch as shown in FIGS. 1 and 9, the surface 940 substantially abuts against surface 950 (i.e., it could actually abut or very nearly abut).

B. Method of Tightening Fence Wire to a Post

The method of operation incorporating the second embodiment of the fulcrum bar 900 is illustrated in FIGS. 13–17. FIGS. 13–15 correspond to the method in FIG. 5. The excess portion 102 of the wire 103 is bent back along extended portion 102 and twisted into a twist portion 104 wherein a loop **104*a* is formed. As shown in FIG. 13, the loop 104*a* is placed over the cap 930 onto the main portion of the fulcrum bar 900. The tool 10 is closed to allow wire gripping surfaces 25 to grip the bight of wire 103 and the user applies firm pressure in the direction of arrow 1300 so as to obtain a tight grip on wire 103 with gripping surfaces 25. The user of the tool 10 then moves the handles 13 and 14 in the direction of arrow 1310 which causes the wire 103 to move in the direction of arrow 1320 around the post 101 so that wire 102 moves in the direction of arrow 1330**.

A pivot point 1350 occurs between the fulcrum bar 900 and where the wire 103 is gripped by surfaces 25. This pivot point 1350 as shown in FIG. 14 is centrally located between fulcrum 900 and the point where the gripping surfaces 25 grip the wire 103.

As shown in FIG. 14, this process can be repeated in a ratcheting manner as shown by arrows 1400 and 1410 to continually tighten the wire 103. For example, when the tool 10 is in position 1420, the user releases the gripping surfaces 25 and moves the tool 10 back to position 1430 to obtain a new grip and the process is repeated.

When the wire 103 reaches desired tightness, and as shown in FIG. 15, the operator of the tool 10 moves the tool in the direction of arrow 1500 which is generally on the ground or angled with respect to wire 103 to form a twist 1510 which firmly engages the loose end 102 about wire 103.

In this second embodiment and as shown in FIGS. 13–15, the fulcrum bar serves the following important purposes. First, before tightening wire 103, the loop 104*a* is easily placed over the cap and onto the bar portion of the fulcrum bar 900. The cap 930 prevents the loop 104*a* from slipping off the bar during the tightening process. However, when the twist 1510 is performed, it is very easy to remove the loop 104*a* from the fulcrum bar 900, especially due to the flush surface 920.

C. Method of Splicing Two Wires Together

In FIGS. 16(*a*), (*b*), and (*c*), which correspond to FIG. 6 of the first embodiment, the tool 10 is used to splice two wires 202 and 203 together. Wire 203 is tied to the post 101 and a loop is created by twisting the bitter end 204 to create loop 204*a*. The end 205 of wire 202 is placed through the loop as shown in FIG. 16(*a*) and then backwards toward the wire 202. A second loop 205*a* is formed in end 205 and placed over the end of the fulcrum bar 900. As with respect to FIGS. 13–15, the gripping surfaces 25 engage the bight of wire 202 and a pivot point 1600 is created between gripping surfaces 25 and fulcrum bar 900. In FIG. 16(*c*), the handle of the tool 10 is moved in the direction of arrow 1610 which causes the opposite end of the tool to move about the pivot point 1600 in the direction of arrow 1620. This causes wire 202 to move in the direction of arrow 1630 and it causes end 205 to move in the direction of arrow 1640. At this time, both wires 203 and 202 are being stretched. The same type of ratcheting can then occur as illustrated in FIG. 14 and end 205 can then be twisted by moving the tool 10 as shown in FIG. 15. This procedure effectively splices the two wires 203 and 202 tightly together.

A second approach to the wire splicing method of FIG. 16 is shown in FIGS. 17(*a*) and 17(*b*). This approach corresponds more closely to that of FIG. 6. In this embodiment, a loop 205*a* is not created in end 205. Rather, the fulcrum bar 900 engages a portion of wire 202 and end 205 is gripped in the gripping surfaces 25 so as to create a pivot point 1700 between the fulcrum 900 and the point of gripping. The handles of tool 10 are then moved as shown in FIG. 17(*b*) in the direction of arrow 1710 which causes the wire 202 to move in the direction of arrow 1720 and which causes the end 205 to move in the direction of arrow 1730 through the formed loop 204*a*. Again, ratcheting can occur as previously discussed and the wire can be effectively twisted together also as previously discussed.

Although specific applications, materials, components, connections, sequences of events, and methods have been stated in the above description of the preferred embodiment of the invention, other suitable materials, other applications, components, and process steps as listed herein may be used with satisfactory results and varying degrees of quality. In addition, it will be understood that various other changes in details, materials, steps, arrangement of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A method of securing fencing wire to a post, said method comprising the steps of:

a) providing a fencing tool having a first elongate portion with a working end and a handle end and a second elongate portion with a working end and a handle end joined at a pivot to said first elongate portion between the working end and the handle end of both the first and the second elongate portions wherein said second elongate portion is provided with a fulcrum bar located between said working end and said pivot and wherein said handle end of said first elongate portion and said handle end of said second elongate portion are both provided with wire-gripping surfaces to grip the fencing wire between said surfaces;

b) forming a loop in a free end of the fencing wire;

c) providing a bight in the fencing wire;

d) running the free end of the fencing wire containing the formed loop about the post and back upon a portion of the fencing wire so as to be in a substantially parallel spaced relationship with the bight;

e) inserting said loop in the free end of the fencing wire over said fulcrum bar;

f) engaging the bight of the fencing wire with said wire-gripping surfaces to form a pivot point between the loop and the bight;

g) applying force directed towards the post to said first and said second handle ends to stretch the fencing wire;

h) twisting the free end of the fencing wire around said portion by rotating said fencing tool about the bight so as to secure the stretched fencing wire to the post; and i) removing the loop from over the fulcrum bar.

2. A method of securing the free end of two fencing wires together, said method comprising the steps of:

a) providing a fencing tool having a first elongate portion with a working end and a handle end and a second elongate portion with a working end and a handle end joined to a pivot to said first elongate portion between the working end and the handle end of both the first and the second elongate portions wherein said second elongate portion is provided with a fulcrum bar located between the working end and the pivot and wherein said handle end of said first elongate portion and said handle end of said second elongate portion are both provided with wire-gripping surfaces to grip a fencing wire between said surfaces;

b) forming a loop in the free end of the first fencing wire;

c) running the free end of the second wire around said fulcrum means and through said formed loop in said first wire;

d) engaging the free end of the second wire with said wire-gripping surfaces;

e) applying force directed toward the second wire to said first and said second handle ends to stretch both said first and second wires;

f) wrapping the free end of the second wire around the stretched second wire to connect said stretched second wire to said stretched first wire.

3. A method of securing the free end of two fencing wires together, said method comprising the steps of:

a) providing a fencing tool having a first elongate portion with a working end and a handle end and a second elongate portion with a working end and a handle end joined to a pivot to said first elongate portion between the working end and the handle end of both the first and the second elongate portions wherein said second elongate portion is provided with a fulcrum bar located between the working end and the pivot and wherein said handle end of said first elongate portion and said handle end of said second elongate portion are both provided with wire-gripping surfaces to grip a fencing wire between said surfaces;

b) forming a loop in the free end of the first fencing wire;

c) running the free end of the second wire through said formed loop in said first wire;

d) forming a loop in the free end of the second wire;

e) providing a bight in the second wire;

f) engaging the aforesaid loop in the free end of the second wire around the fulcrum bar;

g) engaging the bight of the second wire with said wire-gripping surfaces;

h) applying force directed toward the second wire to said first and said second handle ends to stretch both said first and second wires;

i) wrapping the free end of the second wire around the stretched second wire to connect said stretched second wire to said stretched first wire.

* * * * *